US009702280B2

(12) United States Patent
Kira et al.

(10) Patent No.: US 9,702,280 B2
(45) Date of Patent: Jul. 11, 2017

(54) BLOW-BY GAS RECIRCULATION APPARATUS

(71) Applicant: AISIN SEIKI KABUSHIKI KAISHA, Kariya-shi, Aichi (JP)

(72) Inventors: Naoki Kira, Nagoya (JP); Atsushi Nishigaki, Anjo (JP); Takahiro Inokuchi, Tokai (JP)

(73) Assignee: AISIN SEIKI KABUSHIKI KAISHA, Aichi-Ken (JP)

( * ) Notice: Subject to any disclaimer, the term of this patent is extended or adjusted under 35 U.S.C. 154(b) by 21 days.

(21) Appl. No.: 14/440,484

(22) PCT Filed: Nov. 11, 2013

(86) PCT No.: PCT/JP2013/080429

§ 371 (c)(1),
(2) Date: May 4, 2015

(87) PCT Pub. No.: WO2014/080787

PCT Pub. Date: May 30, 2014

(65) Prior Publication Data

US 2015/0354420 A1 Dec. 10, 2015

(30) Foreign Application Priority Data

Nov. 22, 2012 (JP) ..... 2012-256712

(51) Int. Cl.
*F01M 13/00* (2006.01)
*F01M 13/02* (2006.01)
(Continued)

(52) U.S. Cl.
CPC ..... *F01M 13/02* (2013.01); *F01M 9/101* (2013.01); *F01M 13/00* (2013.01); *F01M 13/04* (2013.01);
(Continued)

(58) Field of Classification Search
CPC ..... F01M 13/02; F01M 13/00; F01M 13/04; F01M 9/101; F01M 13/0416;
(Continued)

(56) References Cited

U.S. PATENT DOCUMENTS 4,473,043 A * 9/1984 Furukawa ..... F01M 1/02 123/196 AB
7,263,984 B2 * 9/2007 Wade ..... F01M 13/0011 123/572
(Continued)

FOREIGN PATENT DOCUMENTS

JP 60-222692 A 11/1985
JP 61- 122313 U 8/1986
(Continued)

OTHER PUBLICATIONS

International Search Report (PCT/ISA/210) mailed on Feb. 4, 2014, by the Japanese Patent Office as the International Searching Authority for International Application No. PCT/JP2013/080429.
(Continued)

*Primary Examiner* — Marguerite McMahon
(74) *Attorney, Agent, or Firm* — Buchanan Ingersoll & Rooney PC

(57) ABSTRACT

A blow-by gas recirculation apparatus which can release freezing of a PCV valve in a short period of time is obtained with a simple configuration. The blow-by gas recirculation apparatus is provided with the PCV valve at a case member of a gas space portion to which blow-by gas is sent in a manner that the PCV valve penetrates through the case member and a return path supplying the blow-by the gas, which is from the PCV valve, to an induction system of an engine. A heating portion to which part of oil lubricating the engine is supplied and thus which heats the PCV valve with heat of the oil is formed.

16 Claims, 4 Drawing Sheets

(51) Int. Cl.
*F02F 7/00* (2006.01)
*F01M 13/04* (2006.01)
*F01M 9/10* (2006.01)

(52) U.S. Cl.
CPC ..... *F01M 13/0416* (2013.01); *F02F 7/006* (2013.01); *F02F 7/0095* (2013.01); *F01M 13/0011* (2013.01); *F01M 2013/0427* (2013.01); *F01M 2013/0472* (2013.01)

(58) Field of Classification Search
CPC ..... F01M 13/011; F01M 2013/0472; F01M 2013/0427; F02F 7/006; F02F 7/0095
USPC ..... 123/572–574
See application file for complete search history.

(56) References Cited

U.S. PATENT DOCUMENTS

| | | | | |
|---|---|---|---|---|
| 2005/0081814 | A1* | 4/2005 | Saito ..... | F01M 11/0004 123/195 C |
| 2007/0204828 | A1* | 9/2007 | Nagahashi ..... | F02B 61/02 123/192.2 |
| 2013/0213370 | A1 | 8/2013 | Shirabe et al. | |

FOREIGN PATENT DOCUMENTS

| | | | |
|---|---|---|---|
| JP | 64-15710 | U | 1/1989 |
| JP | 1-315610 | A | 12/1989 |
| JP | 2-40013 | A | 2/1990 |
| JP | 5-86828 | A | 4/1993 |
| JP | 0913929 | A | 1/1997 |
| JP | 10-103040 | A | 4/1998 |
| JP | 2003013721 | A | 1/2003 |
| JP | 2007-127014 | A | 5/2007 |
| JP | 2008-038839 | A | 2/2008 |
| JP | 2008-038845 | A | 2/2008 |
| JP | 2008-215191 | A | 9/2008 |
| JP | 2009150289 | A | 7/2009 |
| JP | 2009150351 | A | 7/2009 |
| JP | 2010-173548 | A | 8/2010 |
| JP | 2012087734 | A | 5/2012 |
| KR | 2003-0092631 | A | 12/2003 |

OTHER PUBLICATIONS

Written Opinion (PCT/ISA/237) mailed on Feb. 4, 2014, by the Japanese Patent Office as the International Searching Authority for International Application No. PCT/JP2013/080429.

Notification of Transmittal of Translation of the International Preliminary Report on Patentability (Forms PCT/IB/338 and PCT/IB/373) and the Written Opinion of the International Searching Authority (Form PCT/ISA/237) issued on May 26, 2015, in the corresponding International Application No. PCT/JP2013/080429. (8 pages).

The extended European Search Report issued on Oct. 23, 2015, by the European Patent Office in corresponding European Application No. 13857449.6. (5 pages).

Office Action (Notification of Reasons for Refusal) issued on Aug. 30, 2016, by the Japanese Patent Office in corresponding Japanese Patent Application No. 2012-256712 and an English translation of the Office Action. (9 pgs).

Office Action issued on Oct. 31, 2016, by the State Intellectual Property Office of China in corresponding Chinese Patent Application No. 201380059534.5 and English translation of the Office Action. (13 pages).

Japanese Official Action issued Feb. 2, 2016, by the Japan Patent Office, in corresponding Japanese Patent Application No. 2012-256712 (6 pages).

* cited by examiner

BLOW-BY GAS RECIRCULATION APPARATUS

TECHNICAL FIELD

The present invention relates to a blow-by gas recirculation apparatus, and specifically relates to a measure against freezing of a PCV valve sending out blow-by gas, which occurs at an engine, from the engine.

BACKGROUND ART

Blow-by gas including unburnt gas generated at an engine includes moisture. For example, in a case where the engine stops in a cold district, the moisture of the blow-by gas remaining inside a PCV valve may freeze. Thus, technique related to a measure against the freezing of the PCV valve includes technique, for example, presented in Patent document 1, wherein a freeze detection portion detecting presence/absence of the freezing of the PCV valve and a freeze release portion releasing the freezing of the PCV valve are described.

That is, in Patent document 1, a blow-by gas recirculation apparatus which sends the blow-by gas to a surge tank for air-intake via the PCV valve provided at a head cover is configured. A thermal heater is provided at a position of an outer circumference of the PCV valve, and the thermal heater is electrified in a case where the freeze detection portion detects that "freezing is present", and thus the freezing is released.

In addition, Patent document 2 presents a configuration where a heating pipe is fixedly attached to an outer circumference of a PCV passage so that the freezing at a union at an intake manifold-side at the PCV passage is released, although it is not a configuration which releases the freezing of the PCV valve. According to Patent document 2, a high-temperature coolant water heated at an engine is supplied to the heating pipe, and thus the freezing within the PCV passage is removed.

DOCUMENT OF KNOWN ART

Patent Document

Patent document 1: JP2010-173548A
Patent document 2: JP2008-215191A

OVERVIEW OF INVENTION

However, according to the configuration using the thermal heater that is electrified to release the freezing, a control apparatus or the like which controls the thermal heater is needed. Accordingly, the configuration of the apparatus is complicated, thereby leading to, for example, increased costs and thus there is room for improvement.

To the contrary, according to the configuration using the coolant water of the engine as a heat source, the configuration is simple because the control apparatus is unnecessary. However, it takes time for temperature of the coolant water to rise, and the freezing cannot be released quickly.

An object of the present invention is to obtain a blow-by gas recirculation apparatus which can release freezing of a PCV valve in a short time period and which includes a simple configuration.

A characteristic of the present invention is that a blow-by gas recirculation apparatus includes a PCV valve provided at a case member of a gas space portion to which blow-by gas occurring at an engine is sent in a manner that the PCV valve penetrates through the case member, a return path supplying the blow-by gas, which is sent out from the PCV valve, to an induction system of the engine, and a heating portion to which part of oil lubricating the engine is supplied, and thus the heating portion transmitting heat of the oil to the PCV valve.

According to the configuration, the oil heated at the engine is supplied to the heating portion of the PCV valve, and thus the freezing of the PCV valve can be removed. Specifically, the oil includes a smaller specific heat compared to coolant water and is supplied also to a portion, such as an inner surface of a cylinder of the engine, at which temperature becomes high, and therefore temperature of the oil becomes high in a relatively short period of time. For these reasons, the heat is transmitted from the oil to the PCV valve by providing an oil passage supplying the heat of the oil to the heating portion, thereby removing the freeze.

In the present invention, the heating portion may be formed by a heating oil passage provided at an inside of a thick wall portion of the case member through which the PCV valve penetrates.

According to the configuration, at the portion through which the PCV valve penetrates, the case member is in close contact with an entire circumference of an outer surface of the PCV valve. By forming the heating oil passage at the inside portion of the thick wall portion of the case member, the heat from the case member can be transmitted to the PCV valve via the contact surface of the closely contacted portion, and thus heating can be conducted. In addition, because the heating oil passage is formed at the inside portion of the thick wall portion of the case member, there is no need to form piping, through which the oil is flowed, at an outer surface and/or an inner surface of the case member. Further, there is no need to provide pipes or the like for heating at the outer surface of the PCV valve to make the heat to act on the PCV valve from the case member.

In the present invention, the heating portion may be provided with a heating space portion formed at an inside of a thick wall portion of the case member through which the PCV valve penetrates and the heating portion may be provided with a nozzle spraying the oil, in the heating space portion, towards a penetration portion through which the PCV valve penetrates.

According to this, at the heating space portion, it is configured in such a manner that the oil is sprayed from the nozzle and thus the penetration portion is heated. Consequently, there is no need to fill the entire heating space portion with the oil, thereby reducing oil amount used for heating. In addition, the sprayed oil is moved within the heating space portion by dynamic inertia and reaches a destination position of an inner surface of the heating space portion. Accordingly, the heat of the oil can be given to the PCV valve without being lost due to unnecessary contact with an inner wall of the heating space portion after the spray.

In the present invention, the heating portion may be formed by a storage space portion storing the oil and formed at an inside of a thick wall portion of the case member through which the PCV valve penetrates.

According to this, the heating is realized simply by forming the storage space portion. In addition, because the storage space portion is configured to store therein the oil, pressure of an oil passage connected to the storage space portion does not decrease or decreases only slightly. Consequently, for example, even in a case where the oil branched from an intermediate portion of an oil passage supplying the oil to hydraulic equipment is connected to the storage space portion, the hydraulic equipment can be operated normally and there is no need to provide an oil passage exclusively for heating.

In the present invention, whole of the case member may be made of resin and metal material may be inserted in a portion which is from the heating portion to the PCV valve.

According to this, utilizing a characteristic of the metal material, that is, the metal material includes a higher coefficient of thermal conductivity than the resin, the heat of the oil is transmitted from the heating portion to the metal material and this heat is transmitted from the metal material to the PCV valve appropriately, and thus the freezing is eliminated in a short period of time.

MODE FOR CARRYING OUT INVENTION

An embodiment of the present invention will be described hereunder with reference to the drawings.

[Basic Configuration]

Figure 1:
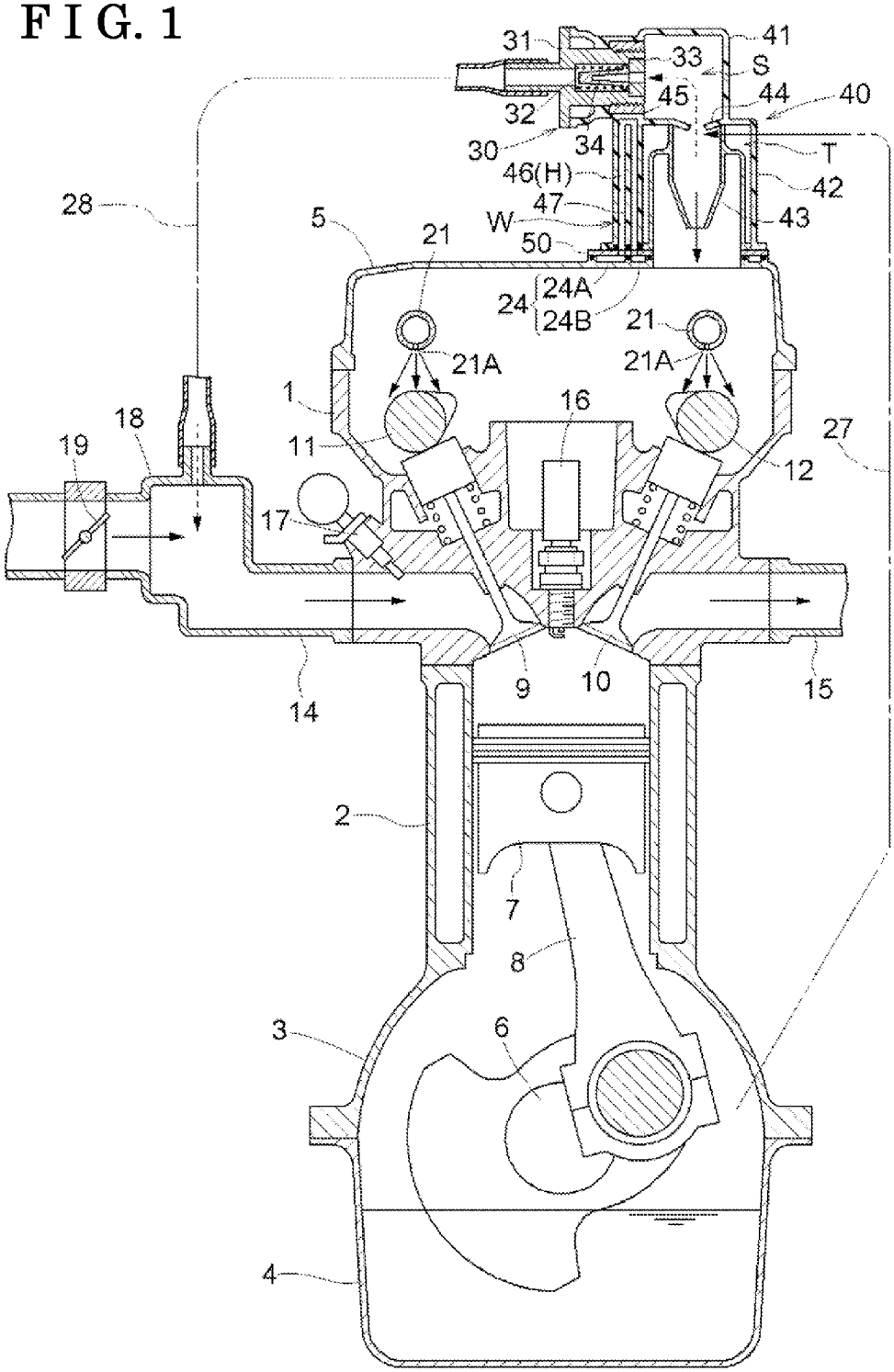
FIG. 1 Cross-sectional view illustrating an engine and a blow-by gas recirculation apparatus FIG. 2 Cross-sectional view illustrating an oil separator, a PCV valve and a heating portion FIG. 3 Cross-sectional view illustrating a heating portion of another embodiment (a)
Figure 2:
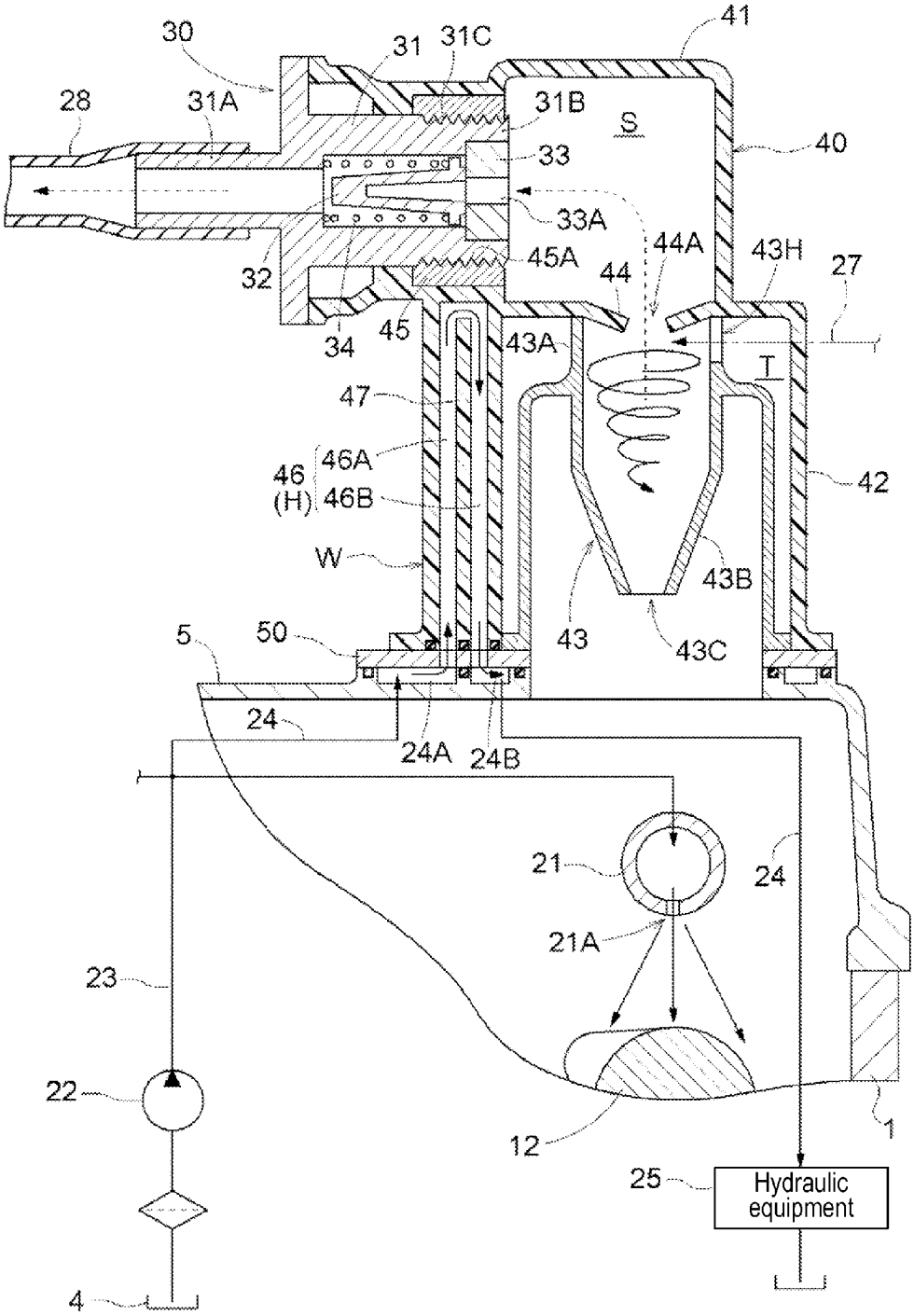

FIG. 1 and FIG. 2 illustrate an engine to be provided at, for example, a vehicle. The engine includes a cylinder head 1, a cylinder block 2, a crankcase 3 and an oil pan 4 which are placed up and down to be arranged one above another, and are connected to one another, and a head cover 5 is provided at an upper portion of the cylinder head 1.

A crankshaft 6 is rotatably supported inside of the crankcase 3 and plural pistons 7 are slidably fitted into plural cylinder bores formed at the cylinder block 2. These pistons 7 and the crankshaft 6 are connected to each other with connecting rods 8.

The cylinder head 1 is provided with an air intake valve 9 and an exhaust valve 10 to be able to open and close. At upper positions of the air intake valve 9 and the air exhaust valve 10, an intake cam shaft 11 and an exhaust cam shaft 12, which are in postures that are parallel to the crankshaft 6, are rotatably supported in a state of being parallel to each other.

An intake manifold 14 is provided at one lateral surface of the cylinder head 1, an exhaust manifold 15 is provided at the other lateral surface of the cylinder head 1, and a spark plug 16 igniting air-fuel mixture in a combustion chamber is provided at an upper surface of the cylinder head 1. An injector 17 supplying fuel to the combustion chamber is provided at an air intake passage of the cylinder, a surge tank 18 is provided at an upstream-side relative to the intake manifold 14, and a throttle valve 19 is further provided at an upstream-side relative to the surge tank 18.

Though not shown, a timing chain is wrapped along a crankshaft sprocket provided at a shaft end of the crankshaft 6 and cam sprockets provided at shaft ends of the respective intake cam shaft 11 and exhaust cam shaft 12 so that the intake cam shaft 11 and the exhaust cam shaft 12 are rotated synchronously with rotations of the crankshaft 6. The spark plug 16 and the injector 17 are controlled by a control apparatus (not shown) including ECU, for example.

Due to such a configuration, when the engine is operating, the intake cam shaft 11 and the exhaust cam shaft 12 rotate synchronously with the rotations of the crankshaft 6, and the air intake valve 9 opens an intake port at a predetermined timing due to a compressive force from a cam portion of an outer circumference of the intake cam shaft 11. Similarly thereto, the exhaust valve 10 opens an exhaust port at a predetermined timing due to a compressive force from a cam portion of an outer circumference of the exhaust cam shaft 12.

In addition, the control apparatus such as the ECU conducts control so that the injector 17 injects the fuel into the combustion chamber at the predetermined timing at which the intake valve 9 opens and that the spark plug 16 ignites the air-fuel mixture at a predetermined timing at which the air-fuel mixture of the combustion chamber is compressed.

Inside the head cover 5, feed oil pipes 21 are arranged above the respective intake cam shaft 11 and exhaust cam shaft 12 to be in postures parallel to the cam shafts. Plural spray nozzles 21A sending oil are formed at lower surface-sides of the feed oil pipes 21. The oil from a hydraulic pump 22 driven by the engine is supplied to the feed oil pipes 21 via a supply oil passage 23. Thus, when the engine is operating, the oil from the hydraulic pump 22 is supplied from the supply oil passage 23 to the pair of feed oil pipes 21, and the oil is sprayed from the plural spray nozzles 21A of each of the feed oil pipes 21 to the intake cam shaft 11 and the exhaust cam shaft 12.

Though not shown, a discharge port discharging the oil is formed at the cylinder head 1, and an oil passage returning the oil discharged from the discharge port to the oil pan 4 is formed at the cylinder head 1.

[Blow-by Gas Recirculation Apparatus]

This engine is provided with a blow-by gas recirculation apparatus where blow-by gas occurring in a crank chamber is introduced to an oil separator 40 via a gas extract path 27, and further is supplied from a PCV valve 30 to an induction system (specifically, the surge tank 18) via a return path 28 of gas. The gas extract path 27, the PCV valve 30 and the return path 28 of the gas are referred to as a PCV (Positive Crankcase Ventilation) path. The blow-by gas is supplied to the combustion chamber and burns together with the air fuel mixture.

At the engine, part of mixed gas introduced to the combustion chamber during the operation of the engine, that is, unburnt mixed gas, leaks out to the crank chamber from a gap between an outer circumference of the piston 7 and a cylinder inner circumference. The gas that has leaked in this way is referred to as the blow-by gas, and discharging as is to the atmosphere as exhaust gas is prohibited by law. For this reason and other reasons, the blow-by gas is returned to the induction system of the engine again via the PCV (Positive Crankcase Ventilation) path, and is introduced together with new mixed gas to the combustion chamber to be combusted therein.

The oil separator 40 is supported at an upper surface of the head cover 5 in such a manner that a gasket 50 is sandwiched, and the blow-by gas from the crank chamber is supplied to the oil separator 40 via the gas extract path 27. The oil separator 40 has a function to remove oil mist included in the blow-by gas, and a gas space portion S is formed at an upper position relative to the oil separator 40.

In the present embodiment, for example, a pipe line such as a tube, which takes out the blow-by gas from a through hole formed at the crankcase 3 and/or at a lower portion of the cylinder block 2 and then returns the blow-by gas to the oil separator 40, is assumed as the gas extract path 27. Besides this configuration, a space portion through which the gas flows can be formed from a wall portion of the crankcase 3 to the cylinder head 1 as the gas extract path 27 and/or the blow-by gas can be configured to be sent into an internal space portion of a chain case. The return path 28 of the gas is constituted by a pipe line formed between the PCV valve 30 and the surge tank 18.

The oil separator 40 is provided with the gas space portion S formed inside an upper portion case 41 and is provided with plural separation units 43, which correspond to cyclone-type, formed inside a lower portion case 42. The oil separator 40 is provided with a dividing wall 44 formed at an intermediate portion between the upper portion case 41 and the lower portion case 42, and is provided with an introduction space portion T formed at an outer portion of the separation units 43 at a lower side relative to the dividing wall 44.

The upper portion case 41, the lower portion case 42, the plural separation units 43 and the dividing wall 44 are made of resin material including nylon, for example. Each of the separation units 43 includes a cylindrical portion 43A and a funnel-shaped portion 43B integrally formed at a lower side of the cylindrical portion 43A. An opening portion 43H which is in communication with the introduction space portion T is formed at an outer circumference of the cylindrical portion 43A and a discharge opening 43C is formed at a lower end of the funnel-shaped portion 43B. In addition, a through hole 44A is formed at the dividing wall 44 that is at an upper position of the cylindrical portion 43A of the separation unit 43.

According to this configuration, the blow-by gas supplied to the introduction space portion T is introduced from the opening portion 43H of the separation unit 43 to an inside of the cylindrical portion 43A in a state where the blow-by gas swirls. The oil mist included in the blow-by gas is gathered, collected and separated by centrifugal force due to the swirling. The oil dripping as a liquid droplet is sent from an inner surface of the funnel-shaped portion 43B to the discharge opening 43C, and is collected into an inside of the head cover 5. In addition, the blow-by gas from which the oil mist has been removed is introduced from the through hole 44A of the dividing wall 44 to the gas space portion S.

The oil separator 40 is not limited to the cyclone-type and can be, for example, a labyrinth type where plural case members are arranged at predetermined intervals and the blow-by gas is sent between the case members.

[Blow-by Gas Recirculation Apparatus: PCV Valve]

The PCV valve 30 is provided at a case member W constituting the gas space proton S of the oil separator 40 in a state where the PCV valve 30 penetrates through the case member W. The PCV valve 30 is constituted by a valve main body 31, a valve body 32 movably accommodated in an inner space portion of the valve main body 31, a support member 33 preventing the valve body 32 from falling off and a spring 34 biasing the valve body 32 in a close direction.

A hole portion 33A feeding the blow-by gas to an inside of the valve main body 31 is formed at the support member 33. A tubular portion 31A sending the blow-by gas is formed at the valve main body 31. A nut portion 31B is integrally formed at an outer end side of the valve main body 31 and a male screw portion 31C is formed at an outer circumference of an inner end side of the valve main body 31. The valve main body 31, the valve body 32 and the support member 33 are assumed to be formed by resin material, however, these can be formed by metal material.

Thus, when the engine is operating, the valve body 32 performs an opening operation against the biasing force of the spring 34 in response to a pressure difference between internal pressures of the gas space portion S and the surge tank 18. The opening operation is performed in proportion to the pressure difference, and an operation of sending out the blow-by gas, which has been introduced to the inside of the valve main body 31 via the hole portion 33A of the support member 33, from the tubular portion 31A is performed.

The case member W constituting the gas space portion S of the oil separator 40 is formed in a region from the upper portion case 41 to the lower portion case 42, and a metal ring 45 made of metal material of which thermal conductivity is high, for example, aluminum, is inserted into the case member W. The metal ring 45 constitutes a penetration portion through which the PCV valve 30 penetrates at the case member W. In addition, the metal ring 45 is an example of the metal material which transmits heat from a heating portion H formed at the inside of the cover member W to the PCV valve 30, and a female screw portion 45A with which the male screw portion 31C of the valve main body 31 threadedly engages is formed at an inner circumference of the metal ring 45. Because the male screw portion 31C of the valve main body 31 which is made of the resin material threadedly engages with the female screw portion 45A of the metal ring 45, a metal surface and a resin surface are in close contact appropriately with each other at the threadedly-engaged portion, and thus the gas is restricted from leaking.

[Blow-by Gas Recirculation Apparatus: Heating Portion]

As illustrated in FIG. 2, at an inside of a thick wall portion of the case member W, a heating oil passage 46 serving as the heating portion H heating the PCV valve 30 is formed. The heating oil passage 46 is constituted by a supply-side path 46A sending the oil in a direction which comes close to the metal ring 45 serving as the penetration portion and a discharge-side path 46B flowing the oil in a direction which is away from the metal ring 45.

The supply-side path 46A and the discharge-side path 46B form a space portion at the inside of the thick wall portion of the case member W, and the space portion includes a deep recessed shape that reaches from a bottom portion of the case member W to the vicinity of the metal ring 45. By inserting a partition wall 47 into the space portion, the supply-side path 46A and the discharge-side path 46B are formed at the inside of the thick wall portion of the case member W.

At the blow-by gas recirculation apparatus, an oil passage system is configured in such a manner that the oil from a control oil passage 24 branching from the supply oil passage 23 is caused to pass through the heating oil passage 46 (the heating portion H), and the oil that has passed therethrough in this way is supplied to hydraulic equipment 25 that is needed for the control of the engine. That is, at the upper surface of the head cover 5, a supply-side space portion 24A to which the oil from the control oil passage 24 is supplied and a discharge-side space portion 24B which sends out the oil are formed to include recessed shapes. The supply-side space portion 24A is in communication with the supply-side path 46A and the discharge-side space portion 24B is in communication with the control oil passage 24 sending the oil to the hydraulic equipment 25. A through hole allowing the oil to flow therethrough is formed at the gasket 50.

At the start-up of the engine, the oil in the oil pan 4 is supplied from the hydraulic pump 22 to each portion of the engine as lubricating oil and part thereof is supplied from the supply oil passage 23 to the pair of feed oil pipes 21. In addition, part of the oil sent from the hydraulic pump 22 to the supply oil passage 23 is supplied as control oil to the hydraulic equipment 25 controlling the engine, after being supplied from the control oil passage 24 to the heating oil passage 46.

In addition, the oil which is sent to vicinity of the penetration portion flows to the discharge-side path 46B, returns from the discharge-side space portion 24B to the control oil passage 24, and is finally supplied to the hydraulic equipment 25. Specifically, as the heating oil passage 46 is divided by the partition wall 47 into the supply-side space portion 24A and the discharge-side path 46B, the oil sent to the discharge-side path 46B does not mix with the oil sent to the supply-side space portion 24A, and therefore the heat of the oil sent to the supply-side space portion 24A is not taken away.

That is, the oil used for the lubrication includes a smaller specific heat compared to coolant water and the oil used for the lubrication is in contact with a surface such as a piston and/or a cylinder inner surface of the engine which come to be in a high-temperature state, and thus a temperature of the oil increases in a short period of time. For these reasons, the oil supplied from the control oil passage 24 to the supply-side space portion 24A flows to the supply-side path 46A of the heating oil passage 46 and transmits the heat of the oil to the metal ring 45 serving as the penetration portion of the PCV valve 30. Thus, even in a case where the PCV valve 30 freezes in a cold district, the heat from the oil is efficiently transmitted to the PCV valve 30, thereby releasing the freezing in a short period of time.

[Other Embodiment]

The present invention can be configured as follows in addition to the above-described embodiment.

Figure 3:
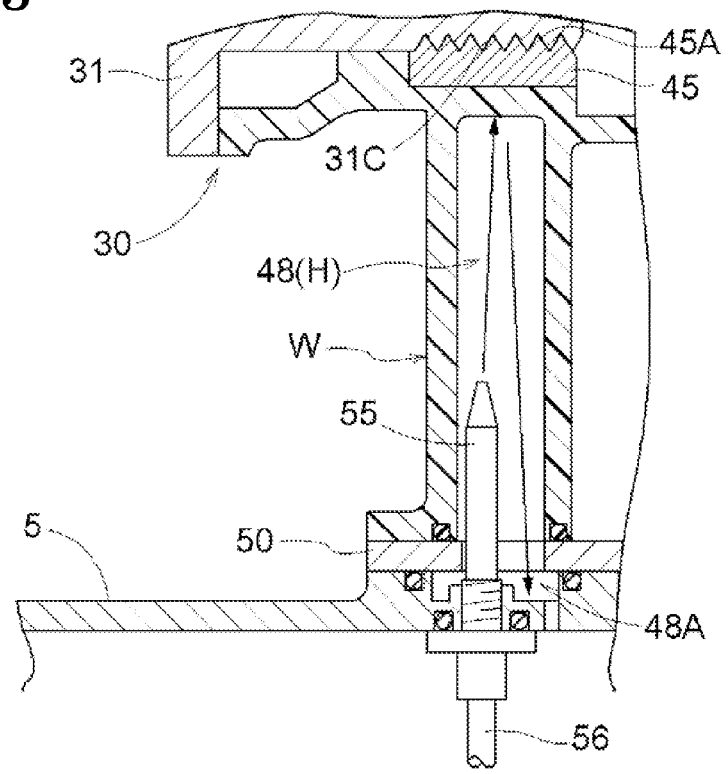

(a) As illustrated in FIG. 3, a heating space portion 48 serving as the heating portion H heating the PCV valve 30 is formed at the inside of the thick wall portion of the case member W. A nozzle 55 for heating, which sprays the oil upwardly from a bottom portion, is provided inside the heating space portion 48, and an oil passage 56 for heating, which is exclusively for heating and which supplies the oil for heating to the nozzle 55 for heating, is connected to the nozzle 55 for heating. In addition, a discharge portion 48A opened to the inside of the head cover 5 is formed at the bottom portion of the heating space portion 48.

Due to the configuration, inside the heating space portion 48, the oil sprayed from the nozzle 55 for heating is sprayed at the vicinity of the penetration portion through which the PCV valve 30 penetrates, and thus the PCV valve 30 can be heated. Specifically, according to the configuration, there is no need to fill the entire heating space portion 48 with the oil, and thus oil amount used for heating can be reduced. Further, the oil sprayed from the nozzle 55 for heating is moved within the heating space portion 48 by dynamic inertia and reaches a destination position (the vicinity of the penetration portion) of an inner surface of the heating space portion 48. Accordingly, the heat of the oil can be supplied to the PCV valve without being lost due to unnecessary contact of the oil with an inner wall of the heating space portion 48 after the spray.

It is difficult in this configuration to pressure-feed the oil after being heated to, for example, the hydraulic equipment. Therefore, the oil passage 56 for heating which is dedicated for heating is provided at the configuration, and the oil after being heated is discharged from the discharge portion 48A to the inside of the head cover 5. Also in such a heating manner, the PCV valve can be heated and thus release of the freezing is realized.

Figure 4:
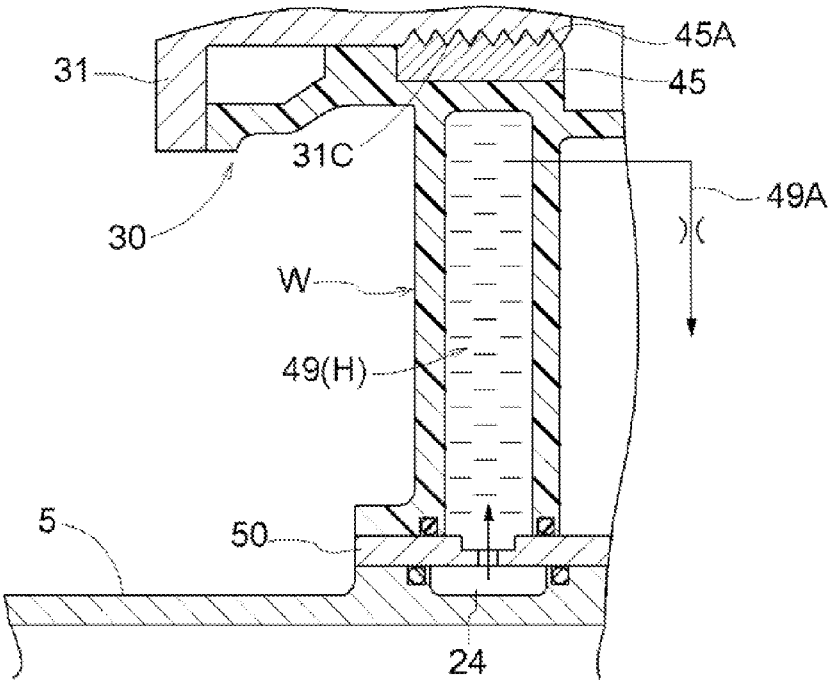
FIG. 4 Cross-sectional view illustrating a heating portion of another embodiment (b)

(b) As illustrated in FIG. 4, as the heating portion H, a storage space portion 49 causing the oil to come into contact with the penetration portion through which the PCV valve 30 penetrates is formed at the inside portion of the thick wall portion of the case member W. The control oil passage 24 is connected to a bottom portion of the storage space portion 49 and a leak oil passage 49A is formed which discharges the oil in small portions little by little from an upper portion via, for example, an orifice.

Due to the configuration, the storage space portion 49 is always filled with the oil and the heat of the oil is transmitted to the vicinity of the penetration portion through which the PCV valve 30 penetrates, and thus the PCV valve 30 is heated. Also in such a heating manner, the PCV valve can be heated and thus the release of the freezing is realized. In addition, because the oil is stored in the storage space portion 49, pressure of the control oil passage 24 connected to the storage space portion 49 does not decrease or decreases only slightly. Accordingly, in a case where the control oil passage 24 is a passage that supplies the oil to the hydraulic equipment 25 (refer to FIG. 2), the hydraulic equipment 25 can be operated appropriately, and there is no need to provide an oil passage which is exclusively for heating.

Figure 5:
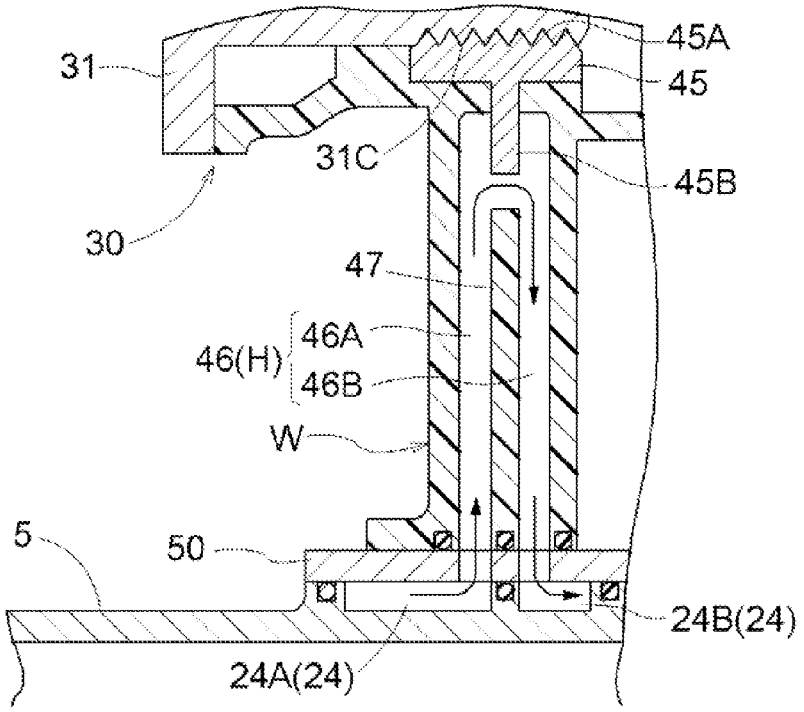
FIG. 5 Cross-sectional view illustrating a heating portion of another embodiment (c)

(c) As illustrated in FIG. 5, a contact portion 45B is formed to protrude downwardly from an outer circumference of the metal ring 45 formed at the case member W and serving as the metal material, and the oil sent to the heating oil passage 46 is made to be in direct contact with the contact portion 45B.

The heating oil passage 46 that is common with the embodiment is illustrated in FIG. 5, however, the configuration of other embodiment (a) and/or the configuration of other embodiment (b) are applicable as the heating manner. Due to the configuration, the heat of the oil in the heating oil passage 46 can be transmitted from the contact portion 45B directly to the metal ring 45, and thus the PCV valve can be heated and the freezing can be released in a short period of time.

Figure 6:
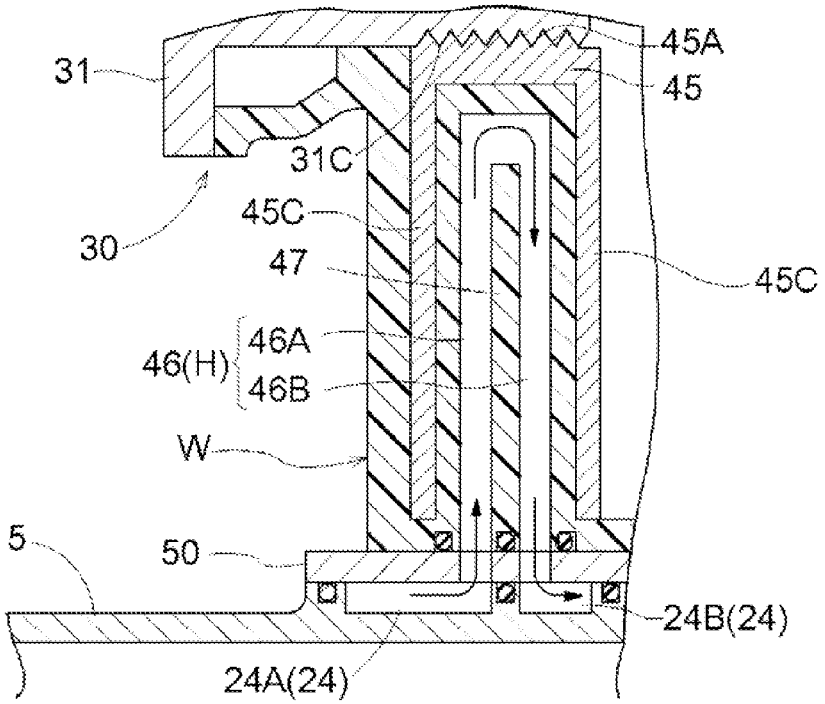
FIG. 6 Cross-sectional view illustrating a heating portion of another embodiment (d)

(d) As illustrated in FIG. 6, a pair of heat receiving pipes 45C is formed in a manner that each heat receiving pipe 45C protrudes downwardly from the outer circumference of each end of the metal ring 45 formed at the case member W and serving as the metal material, and the heating oil passage 46 is formed in a space portion sandwiched between the heat receiving pipes 45C provided as the pair.

The heating oil passage 46 that is common with the embodiment is illustrated in FIG. 6, however, may be combined with the configuration of other embodiment (a) and/or the configuration of other embodiment (b) as the heating manner. Due to the configuration, the heat of the oil in the heating oil passage 46 can be transmitted from the pair of heat receiving pipes 45C directly to the metal ring 45, and thus the PCV valve can be heated and the freezing can be released in a short period of time.

(e) The present invention is characterized in that the oil is used to heat the PCV valve 30, and a configuration may be used, where a metal pipe serving as the heating portion is wrapped around an outer circumference of the PCV valve 30 and the oil flows through the metal pipe. In addition, similarly thereto, a configuration may be used, where an oil chamber serving as the heating portion is formed inside the PCV valve 30 and the oil is supplied and discharged relative to the oil chamber.

INDUSTRIAL APPLICABILITY

The present invention can be applied to an engine including a PCV valve.

The invention claimed is:

1. A blow-by gas recirculation apparatus comprising:

a PCV valve provided at a case member of a gas space portion to which blow-by gas occurring at an engine is sent in a manner that the PCV valve penetrates through the case member;

a return path supplying the blow-by gas, which is sent out from the PCV valve, to an induction system of the engine; and a heating portion provided in an intermediate portion of a control oil passage diverging from a supply oil passage for supplying part of oil lubricating the engine to a feed oil pipe, and thus the heating portion transmitting heat of the oil to the PCV valve.

2. The blow-by gas recirculation apparatus according to claim 1, wherein the heating portion is formed by a heating oil passage provided at an inside of a thick wall portion of the case member through which the PCV valve penetrates.

3. The blow-by gas recirculation apparatus according to claim 1, wherein the heating portion is provided with a heating space portion formed at an inside of a thick wall portion of the case member through which the PCV valve penetrates and the heating portion is provided with a nozzle spraying the oil, in the heating space portion, towards a penetration portion through which the PCV valve penetrates.

4. The blow-by gas recirculation apparatus according to claim 1, wherein the heating portion is formed by a storage space portion formed at an inside of a thick wall portion of the case member through which the PCV valve penetrates and storing the oil.

5. The blow-by gas recirculation apparatus according to claim 2, wherein whole of the case member is made of resin and metal material is inserted in a portion which is from the heating portion to the PCV valve.

6. The blow-by gas recirculation apparatus according to claim 3, wherein whole of the case member is made of resin and metal material is inserted in a portion which is from the heating portion to the PCV valve.

7. The blow-by gas recirculation apparatus according to claim 4, wherein whole of the case member is made of resin and metal material is inserted in a portion which is from the heating portion to the PCV valve.

8. The blow-by gas recirculation apparatus according to claim 1, wherein the case member is provided outside a head cover, and the feed oil pipe is provided inside the head cover.

9. A blow-by gas recirculation apparatus comprising:

a PCV valve provided at a case member of a gas space portion to which blow-by gas occurring at an engine is sent in a manner that the PCV valve penetrates through the case member;

a return path supplying the blow-by gas, which is sent out from the PCV valve, to an induction system of the engine; and a heating portion provided in an intermediate portion of a control oil passage diverging from a supply oil passage for supplying part of oil lubricating the engine to a feed oil pipe, and thus the heating portion transmitting heat of the oil to the PCV valve, wherein oil having passed through the heating portion is supplied to hydraulic equipment for controlling the engine.

10. The blow-by gas recirculation apparatus according to claim 9, wherein the heating portion is formed by a heating oil passage provided at an inside of a thick wall portion of the case member through which the PCV valve penetrates.

11. The blow-by gas recirculation apparatus according to claim 9, wherein the heating portion is provided with a heating space portion formed at an inside of a thick wall portion of the case member through which the PCV valve penetrates and the heating portion is provided with a nozzle spraying the oil, in the heating space portion, towards a penetration portion through which the PCV valve penetrates.

12. The blow-by gas recirculation apparatus according to claim 9, wherein the heating portion is formed by a storage space portion formed at an inside of a thick wall portion of the case member through which the PCV valve penetrates and storing the oil.

13. The blow-by gas recirculation apparatus according to claim 10, wherein whole of the case member is made of resin and metal material is inserted in a portion which is from the heating portion to the PCV valve.

14. The blow-by gas recirculation apparatus according to claim 11, wherein whole of the case member is made of resin and metal material is inserted in a portion which is from the heating portion to the PCV valve.

15. The blow-by gas recirculation apparatus according to claim 12, wherein whole of the case member is made of resin and metal material is inserted in a portion which is from the heating portion to the PCV valve.

16. The blow-by gas recirculation apparatus according to claim 9, wherein the case member is provided outside a head cover, and the feed oil pipe is provided inside the head cover.

* * * * *